US005230173A

United States Patent [19]

Riley

[11] Patent Number: 5,230,173

[45] Date of Patent: Jul. 27, 1993

[54] CELLULAR PHONE INDEX APPARATUS

[76] Inventor: Michael P. Riley, 7516 Autumn Pines Dr., Orlando, Fla. 32822

[21] Appl. No.: 772,554

[22] Filed: Oct. 7, 1991

[51] Int. Cl.[5] ..... B42F 17/02

[52] U.S. Cl. ..... 40/404; 40/593

[58] Field of Search ..... 40/404, 536, 559, 367, 40/593; 248/126, 205.5, 291

[56] References Cited

U.S. PATENT DOCUMENTS

| | | | |
|---|---|---|---|
| 2,415,740 | 2/1947 | Gammack | 248/205.5 X |
| 3,863,370 | 2/1975 | Smith | 40/367 |
| 4,031,645 | 6/1977 | Rose et al. | 40/404 |
| 4,862,614 | 9/1989 | Shetleroe | 40/593 |
| 5,031,865 | 7/1991 | Blattner | 248/126 X |

*Primary Examiner*—James R. Brittain
*Assistant Examiner*—J. Bonifanti
*Attorney, Agent, or Firm*—Leon Gilden

[57] ABSTRACT

A support structure is arranged for mounting within an associated vehicle for use with a cellular phone to provide for the mounting of an aligned row of index cards readily mounted to and supported by the apparatus. A modification of the invention includes illumination as well as magnification structure for cooperation with the organization.

1 Claim, 4 Drawing Sheets

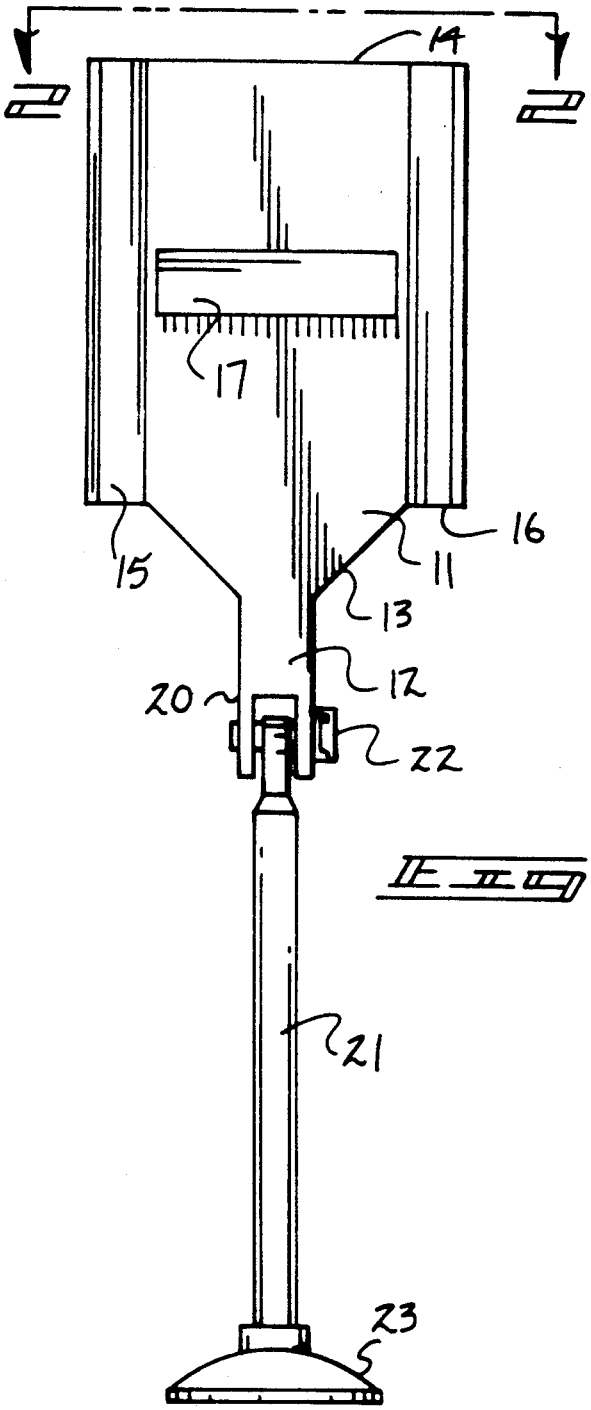
FIG 1
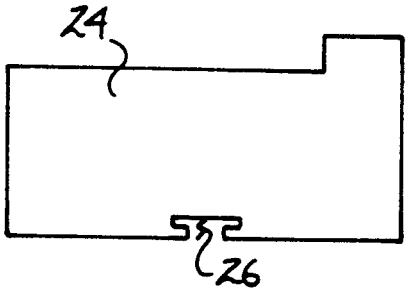
FIG 3
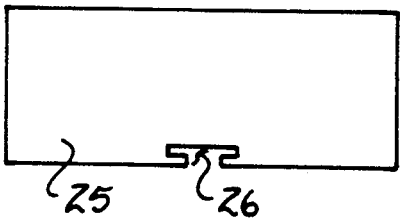
FIG 4
FIG 2
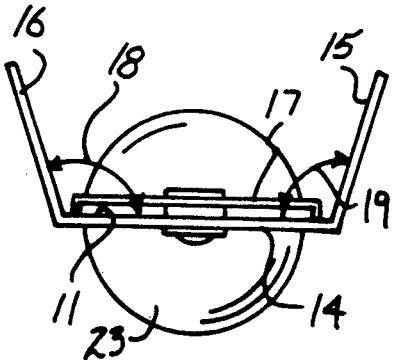

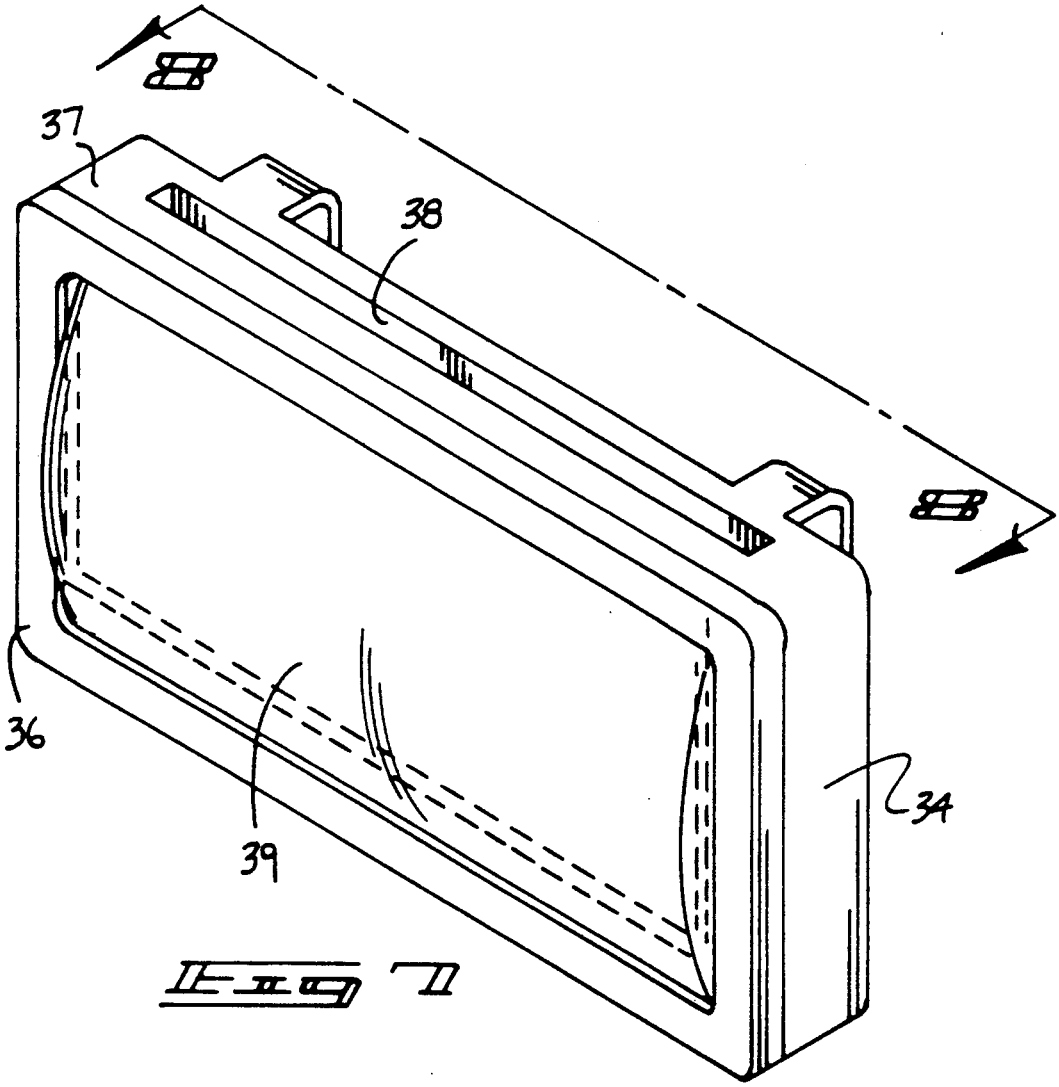
Fig 7
Fig 8
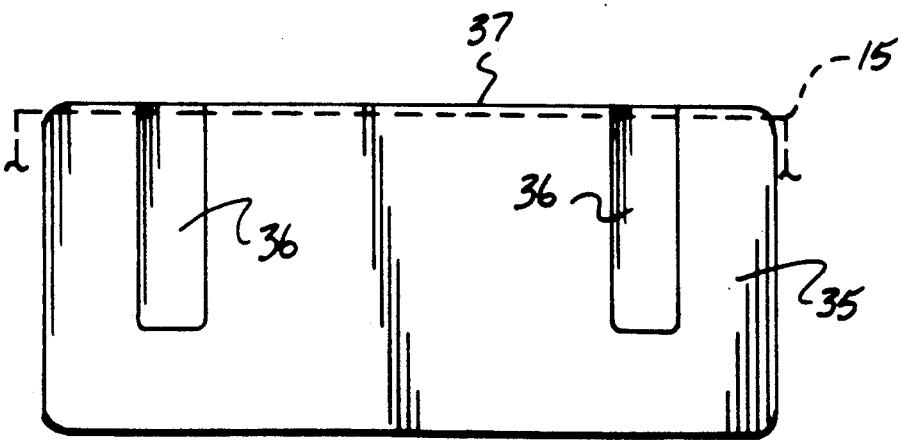

CELLULAR PHONE INDEX APPARATUS

BACKGROUND OF THE INVENTION

1. Field of the Invention

The field of invention relates to cellular phone structure, and more particularly pertains to a new and improved cellular phone index apparatus for use with cellular phones to provide for indexing and support of various telephone information.

2. Description of the prior Art

The advent of the cellular phone within self-propelled vehicles in contemporary society has simultaneously brought forth a need to organize and maintain a manner of providing for index card selection relative to a cellular phone structure prior art structure in use with telephones is exemplified in U.S. Pat. No. 4,864,751 to Halm wherein a telephone index is arranged for utilizing a plurality of section keys and a spring-loaded drawer for providing index information for use with a telephone.

U.S Pat. No. 4,275,519 to Grunstad sets forth a wall mounted telephone index structure.

U.S. Pat. No. 4,862,497 to Seto, et al. sets forth a hybrid telephone directory to provide source of data therewithin.

U.S. Pat. No. 4,706,273 to Spear, et al. sets forth the construction of a cellular phone of a type typically utilized in a portable arrangement relative to transport vehicles and the like.

As such, it may be appreciated that there continues to be a need for a new and improved cellular phone index apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of telephone index apparatus now present in the prior art, the present invention provides a cellular phone index apparatus wherein the same is utilized with a cellular telephone structure such as employed in self-propelled vehicles. As such, the general purpose of the present invention, which will be described subsequently in greater detail, is to provide a new and improved cellular phone index apparatus which has all the advantages of the prior art index apparatus and none of the disadvantages.

To attain this, the present invention provides a support structure arranged for mounting within an associated vehicle for use with a cellular phone to provide for the mounting of an aligned row of index cards readily mounted to and supported by the apparatus. A modification of the invention includes illumination as well as magnification structure for cooperation with the organization My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cellular phone index apparatus which has all the advantages of the prior art index apparatus and none of the disadvantages.

It is another object of the present invention to provide a new and improved cellular phone index apparatus which may be easily and efficiently manufactured and marketed.

It is a further object of the present invention to provide a new and improved cellular phone index apparatus which is of a durable and reliable construction.

An even further object of the present invention is to provide a new and improved cellular phone index apparatus which is susceptible of a low cost of manufacture with regard to both materials and labor, and which accordingly is then susceptible of low prices of sale to the consuming public, thereby making such cellular phone index apparatus economically available to the buying public.

Still yet another object of the present invention is to provide a new and improved cellular phone index apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 an orthographic top view of the instant invention.

FIG. 2 is an orthographic view, taken along the lines 2—2 of FIG. 1 in the direction indicated by the arrows.

FIG. 3 and 4 are orthographic front views of index cards utilized by the invention.

FIG. 7 is an isometric illustration of a magnification lens for use by the invention.

FIG. 8 is an orthographic view taken along the lines 8—8 of FIG. 7 in the direction indicated by the arrows.

DESCRIPTION OF THE PREFERRED EMBODIMENT

Figure 5:
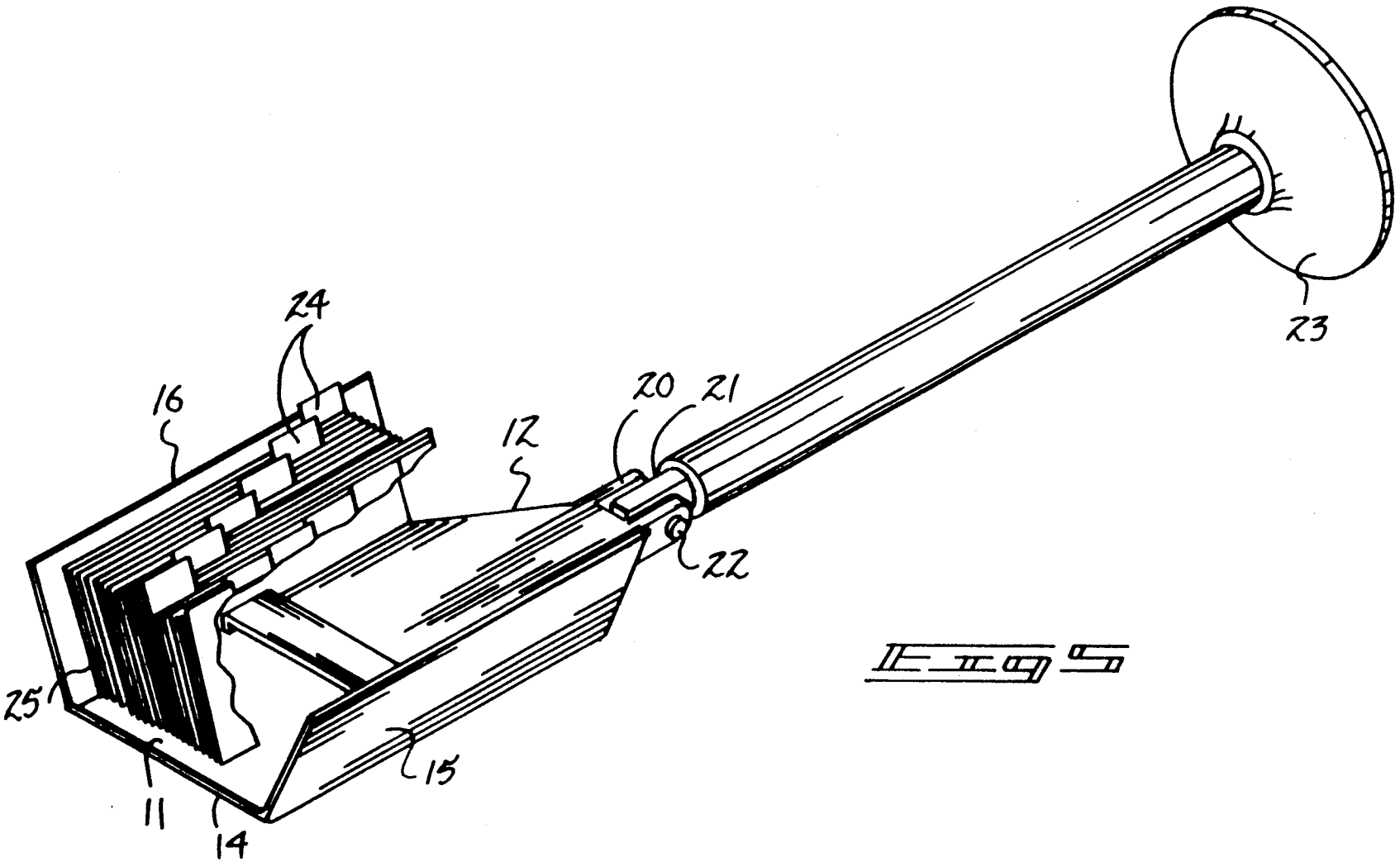
FIG. 5 is an isometric illustration of the instant invention.

With reference now to the drawings, and in particular to FIGS. 1 to 8 thereof, a new and improved cellular phone index apparatus embodying the principles and concepts of the present invention and generally designated by the reference numeral 10 will be described. More specifically, the cellular phone index apparatus 10 of the instant invention essentially comprises a base plate 11, including an extension plate 12 extending coplanar with and laterally of the base plate relative to a second side 13, wherein a first side 14 defines a forward end of the apparatus 10. A front flange plate 15 extends upwardly of a forward edge of the base plate 11, wherein a rear flange plate 16 extends upwardly relative to a rear edge of the base plate 11, wherein the forward and rear edges of the base plate are arranged parallel relative to one another and the respective front and rear flange plates 15 and 16 define respective front and rear flange obtuse angles 19 and 18 respectively relative to the base plate and the respective flange pates. A "U" shaped mounting bar is spaced above and parallel to and medially oriented to bisect the base plate 11 orthogonally oriented relative to the front and rear edges of the base plate 11. The mounting bar 17 positioned above the base plate 11, as illustrated in FIG. 2 for example, permits mounting of an elongate aligned row of first and second index cards 24 and 25, in a manner as illustrated in FIG. 5 for example, for recording various data relative to use in a telephone situation. The extension plate 12 terminates in a bifurcated extension plate free end 20 receiving a mounting leg therewithin relative to a first distal end of the mounting leg 21. A friction clamp 22 orthogonally directed through the bifurcated extension plate free end 20 and the first distal end of the mounting leg 21 permits selective angular mounting of the mounting leg 21 relative to the base plate 11. A second distal end of the mounting le 21 includes a mounting member such as suction cup 23 mounted thereto for securement of the apparatus within an interior compartment of a self-propelled vehicle such as an automobile. It should be noted that the "T" shaped slots 26 mounted medially of a bottom edge of each index card permits selective mounting and removal of the index cards relative to the mounting bar 17.

Figure 6:
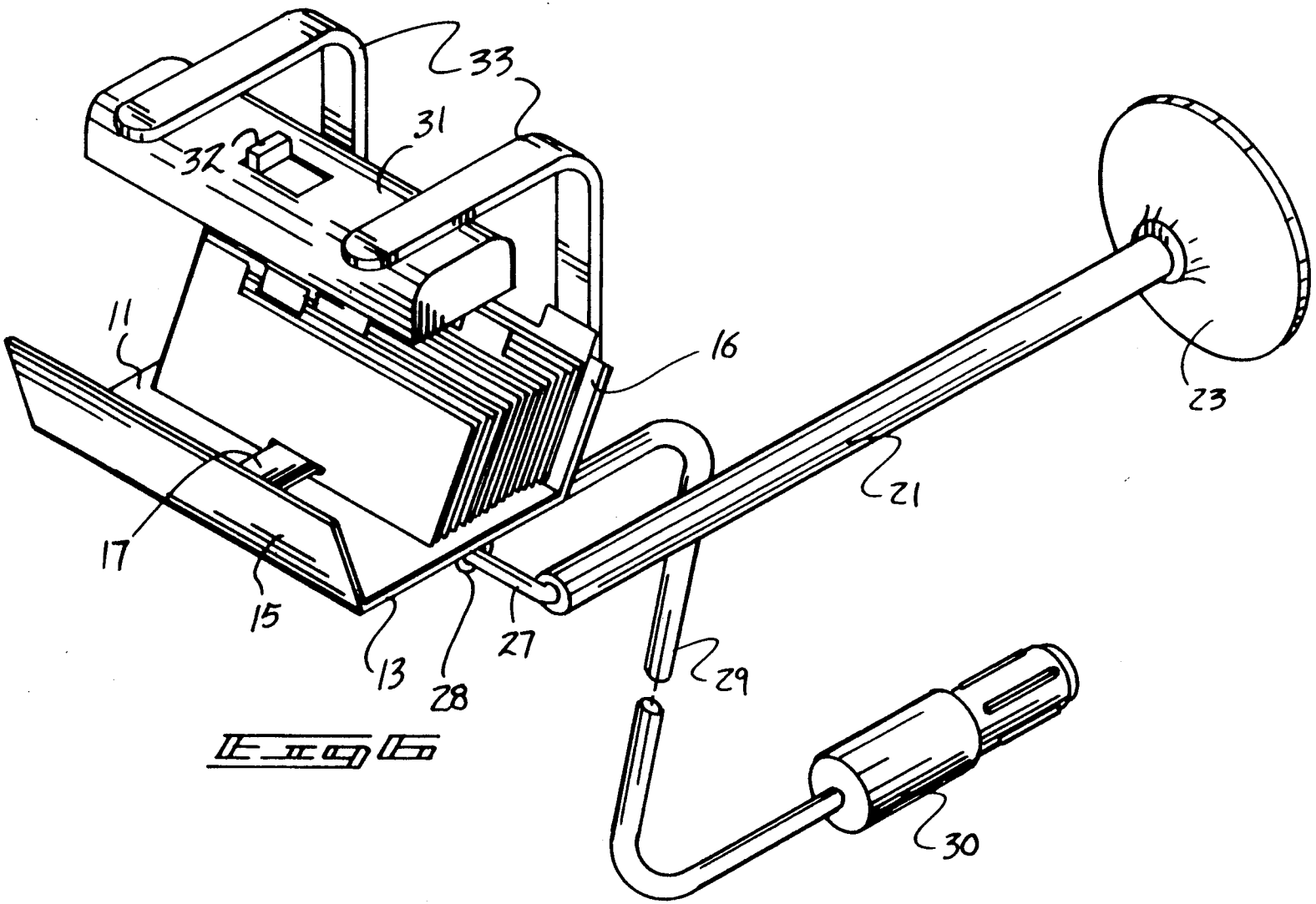
FIG. 6 is an isometric modification of the instant invention.

The FIG. 6 illustrates the use of a modified apparatus to include a connecting link 27 that is frictionally and rotatably received within a receiving tube 28 mounted to a bottom surface of the base plate 11 to permit frictional positioning of the base plate relative to the connecting link 27 that in turn is fixedly secured to the mounting leg 21. A plurality of spaced support legs 33 extend upwardly relative to the rear flange plate 16 and are positioned above the base plate 11 in a spaced parallel relationship to fixedly secure a light housing 31, including an illumination member therewithin operative through an associated light housing switch 32. An electrical transmission line 29 in communication with the light member within the light housing 31 is in electrical communication with a cigarette lighter adapter plug 30 for reception within an associated vehicular cigarette lighter socket.

The FIGS. 7 and 8 illustrate the use of an additional reader housing 34 utilized by the invention that includes a housing rear wall 35 that includes a plurality of housing mounting clips 36 spaced from the rear wall 35 for frictional reception of the front flange plate 15 therewithin. The reader housing 34 includes a front wall 36 and a top wall 37, with a slot 38 directed through the top wall arranged parallel to the front and rear walls. A magnification lens mounted within the front wall is oriented parallel relative to the slot in communication therewith to receive an index card therewithin to enhance visibility of the index card and in association with the illumination light housing 31 permits ease of reading of the various index cards during use of an associated vehicle (not shown).

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may he resorted to, falling within the scope of the invention.

What is claimed as being new and desired to be protected by Letters Patent of the United States is as follows:

1. A cellular phone index apparatus for use within a vehicle, wherein the apparatus comprises, a rigid base plate, the base plate including a first slide edge and a second side edge, and the second side edge including an extension plate extending coplanar with the base plate oriented laterally of the base plate, with the base plate further including a forward edge and a rear edge, wherein the forward edge and rear edge are arranged in a parallel relationship, and a front flange plate mounted coextensively to the forward edge, and a rear flange plate mounted coextensively to the rear edge, wherein the front flange plate and the rear flange plate extend upwardly relative to the base plate, and the front flange plate defines a forward obtuse angle defined between the front flange plate and the base plate, and the rear flange plate defines a rear obtuse angle defined between the rear flange plate and the base plate, and a U-shaped mounting bar fixedly mounted to a top surface of the base plate between the front flange plate and the rear flange plate spaced above and parallel to the base plate medially bisecting the base plate and oriented orthogonally relative to the forward edge and the rear edge, and a plurality of index cards mounted removably relative to the U-shaped mounting bar, wherein each index card includes a bottom edge and the bottom edge includes a T-shaped slot directed medially of the bottom edge for selective securement to the mounting bar, and the extension plate is defined by a connecting link, the connecting link rotatably and frictionally received within a receiving tube, the receiving tube fixedly mounted to a bottom surface of the base plate, and a mounting leg, with a forward distal end of the mounting leg fixedly secured to the connecting link and the rear distal end of the mounting leg including a suction cup member mounted thereto for securement to a surface, and a plurality of spaced support legs fixedly mounted to the rear flange plate extending above the rear flange plate and terminating in a parallel spaced relationship above the top surface of the base plate, and the support legs fixedly securing a light housing therebetween, wherein the light housing is arranged in a spaced parallel relationship above the base plate and the index cards, and a switch member mounted to the light housing for permitting selective actuation of the light housing, and a reader housing, the reader housing including a rear wall, a top wall, and a front wall, the rear wall including a plurality of mounting clips mounted to the rear wall spaced from the rear wall, wherein the mounting clips are arranged for frictional securement of the front flange plate between the mounting clips and the rear wall, and the front wall including a magnification lens mounted therewithin, and a slot directed through the top wall positioned adjacent the magnification lens, wherein the slot is arranged parallel relative to the magnification lens to permit visual observation of an index card presented within the slot.

* * * * *